US006067814A

United States Patent [19]

Imeland

[11] Patent Number: 6,067,814

[45] Date of Patent: May 30, 2000

[54] METHOD FOR COOLING CONTAINERS AND A COOLING SYSTEM FOR IMPLEMENTATION OF THE METHOD

[75] Inventor: Kåre Bjorn Imeland, Oslo, Norway

[73] Assignee: Kvaerner ASA, Lysaker, Norway

[21] Appl. No.: 09/068,816

[22] PCT Filed: Nov. 11, 1996

[86] PCT No.: PCT/NO96/00264

§ 371 Date: May 13, 1998

§ 102(e) Date: May 13, 1998

[87] PCT Pub. No.: WO97/18422

PCT Pub. Date: May 22, 1997

[30] Foreign Application Priority Data

Nov. 14, 1995 [NO] Norway ..... 954600

[51] Int. Cl.[7] ..... F25D 17/02

[52] U.S. Cl. ..... 62/384; 62/434

[58] Field of Search ..... 62/384, 434

[56] References Cited

U.S. PATENT DOCUMENTS

| | | | |
|---|---|---|---|
| 2,541,169 | 2/1951 | Martin | 62/434 |
| 3,156,101 | 11/1964 | McGuffey | 62/434 |
| 3,788,091 | 1/1974 | Miller | 62/384 |
| 4,302,944 | 12/1981 | Gainer | 62/434 |
| 4,695,302 | 9/1987 | Tyree, Jr. | 62/384 |
| 4,751,822 | 6/1988 | Viard | 62/384 |
| 5,177,974 | 1/1993 | Uren et al. | 62/384 |

FOREIGN PATENT DOCUMENTS

| | | |
|---|---|---|
| 2644233 A1 | 9/1990 | France . |
| 2418788 A1 | 10/1975 | Germany . |
| 2748796 A1 | 5/1978 | Germany . |
| 2933814 A1 | 3/1981 | Germany . |
| WO 93/23712 A1 | 11/1993 | WIPO . |

*Primary Examiner*—Ronald Capossela
*Attorney, Agent, or Firm*—Fish & Neave; Robert W. Morris; Edward M. Arons

[57] ABSTRACT

The invention concerns a method for cooling containers, wherein cold is generated in a primary circuit containing a cooling medium. Cold is supplied via a heat exchanger to a cold carrier in a secondary circuit. The secondary circuit's cold carrier flows into a container through pipes with releasable couplings, transferring cold to the container through a heat exchanger. Cold is stored in one or more cold stores in the secondary circuit, in or outside the container, for subsequent emission in the event of an interruption in the cold supply. The invention also concerns a cooling system for implementation of the method.

24 Claims, 2 Drawing Sheets

METHOD FOR COOLING CONTAINERS AND A COOLING SYSTEM FOR IMPLEMENTATION OF THE METHOD

The present invention concerns a method for cooling containers, wherein cold is generated in a primary circuit containing a cooling medium and is supplied via a heat exchanger to a cold carrier in a secondary circuit, where the secondary circuit's cold carrier flows into a container through a heat exchanger.

The invention also concerns a cooling system comprising a primary circuit with a cooling medium for generating cold, a heat exchanger for supply of cold from the cooling medium in the primary circuit to cold carrier in a secondary circuit, the secondary circuit comprising releasable couplings for connecting to a container, the container comprising a heat exchanger for WO93/23712 discloses a method for cooling containers, wherein cold is generated in a primary circuit containing a cooling medium and is supplied via a heat exchanger to a cold carrier in a secondary circuit, wherein the secondary circuit's cold carrier flows into a container through pipes with releasable couplings, transferring cold to the container through a heat exchanger, and wherein cold is stored in cold stores in the secondary circuit.

BACKGROUND OF THE INVENTION

There are previously known cooling systems for cooling containers in connection with transport of food such as fish and the like, where the cold is generated by a primary circuit and transferred to a secondary circuit. An appropriate cold carrier in the secondary circuit, normally brine, transfers the cold into transportable containers, thus cooling their contents. The containers are exposed to cooling in the cooling circuit for as long as possible, whereupon they are disconnected from the circuit for further transport, e.g. by trailer or rail, on the final stage of the journey to the recipient.

Another known method is the use of transport containers with a store of a cold carrier, e.g. ice or dry ice, where the ice or the dry ice is placed in the container together with the goods which require to be cooled, and give off their cold during that part of the transport when the container is not connected to the cooling circuit.

In the known cooling system there is a limit to how long a transport containers can be located outside the cooling system before the contents are warmed to an unacceptable temperature. Alternatively, the cooling medium in the form of ice or dry ice requires to be placed in the container manually or by other means at the same time as the goods are placed therein, which entails extra work and increased costs.

The object of the present invention is to provide a method for cooling containers and a cooling system where the containers can be kept cold in a simple manner without the supply of cold from the cooling system.

This object is achieved with a method and a cooling system of the type mentioned in the introduction, characterized by the features which are indicated in the claims.

SUMMARY OF THE INVENTION

In this patent application the terms "emit cold", "supply cold" and "transfer cold" are used instead of the more correct "supply heat", "emit heat" and "transfer heat". This terminology has been chosen in order to make the description easier to understand.

The invention therefore consists of a cooling system consisting of a primary circuit and a secondary circuit connected to a heat exchanger, where the cold is generated in the primary circuit in the known manner. The cold is transferred from the primary circuit to the secondary circuit via the heat exchanger, where the cold is passed to a container by means of a cold carrier. The secondary circuit has one or more cold stores for storage of cold and emission of cold in the event of an interruption in the cold supply. This interruption may be due to operational problems or a failure of the energy supply to the cooling system, or it may be an interruption in the cold supply resulting from the disconnection of the container from the cooling system.

In a preferred embodiment one of the cold stores is located inside the container, with the result that the container is self-sufficient in cold emission during transport but a cold store may be located either inside or outside the container. It will, therefore, be understood that the principles of cold storage and emission described herein may be applied to methods and systems for storing cold either inside or outside the container.

The cold carrier is pressurized carbon dioxide ($CO_2$). This is a cold carrier which affords moderate dimensions, small volume and no corrosion in the pipe system. The cold store or cold stores may consist of dry ice, which can be generated directly form the carbon dioxide by reducing its pressure. The dry ice can be stored in a separate compartment in the container for subsequent emission of cold when the dry ice turns into carbon dioxide in a gaseous state, which can be done by the emission of the carbon dioxide directly into the container's atmosphere.

The cold store may also consist of an enclosed quantity of pressurized carbon dioxide. When the pressure of the carbon dioxide is reduced, dry ice is produced, which can then emit its cold into the container in the same manner as that described above.

When a cold store is employed in the secondary circuit some carbon dioxide will have to be consumed, thus making it necessary to replenish with new carbon dioxide. Since it is natural to employ the cooling system in connection with transport means with internal combustion engines, such as ships, this carbon dioxide is preferably supplied by means of a carbon dioxide generator which generates carbon dioxide received from the internal combustion engine's exhaust gases.

Figure 1:
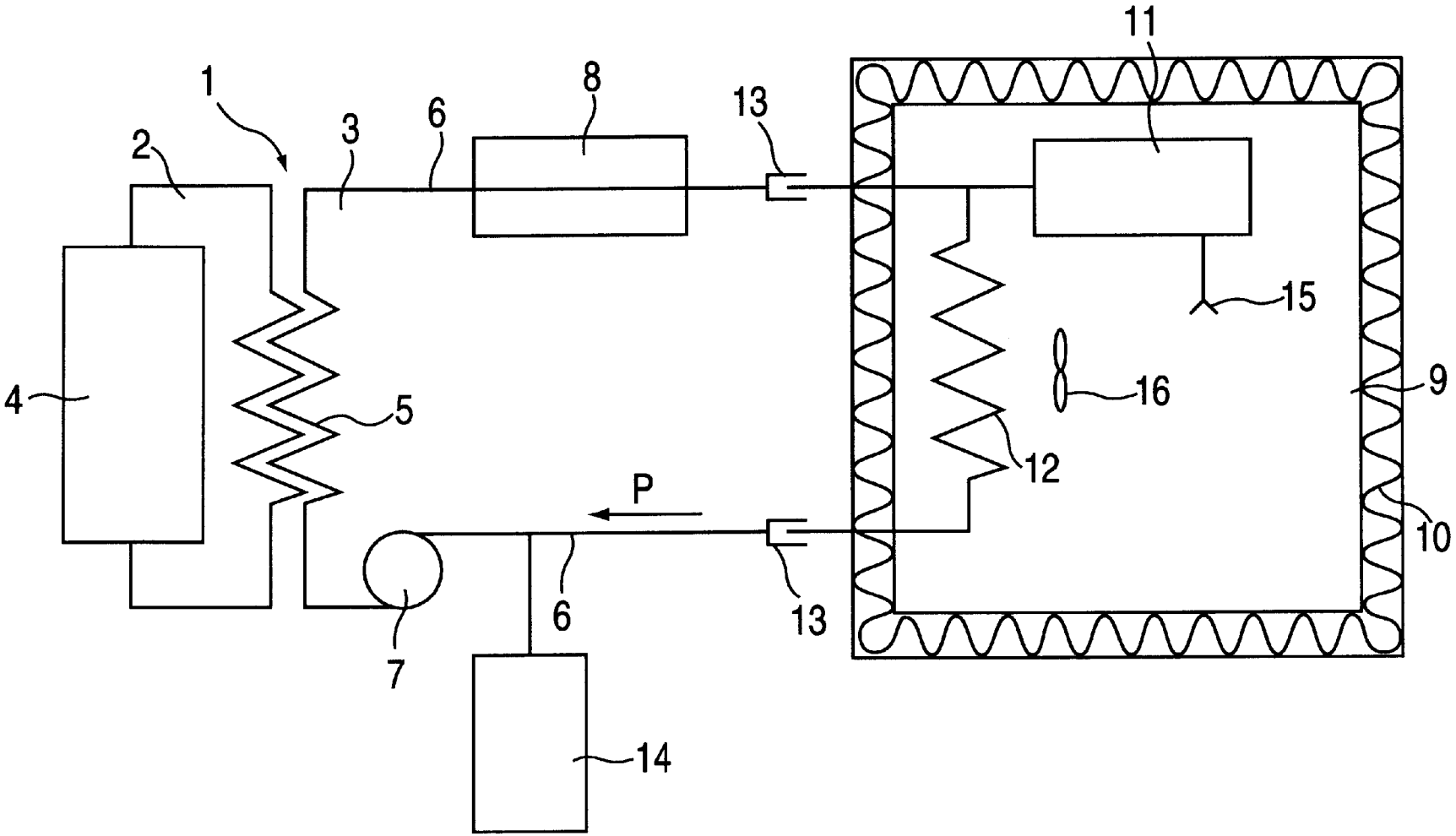
FIG. 1 is a schematic flow chart of a system for cooling a container in accordance with the principles of the present invention.
Figure 2:
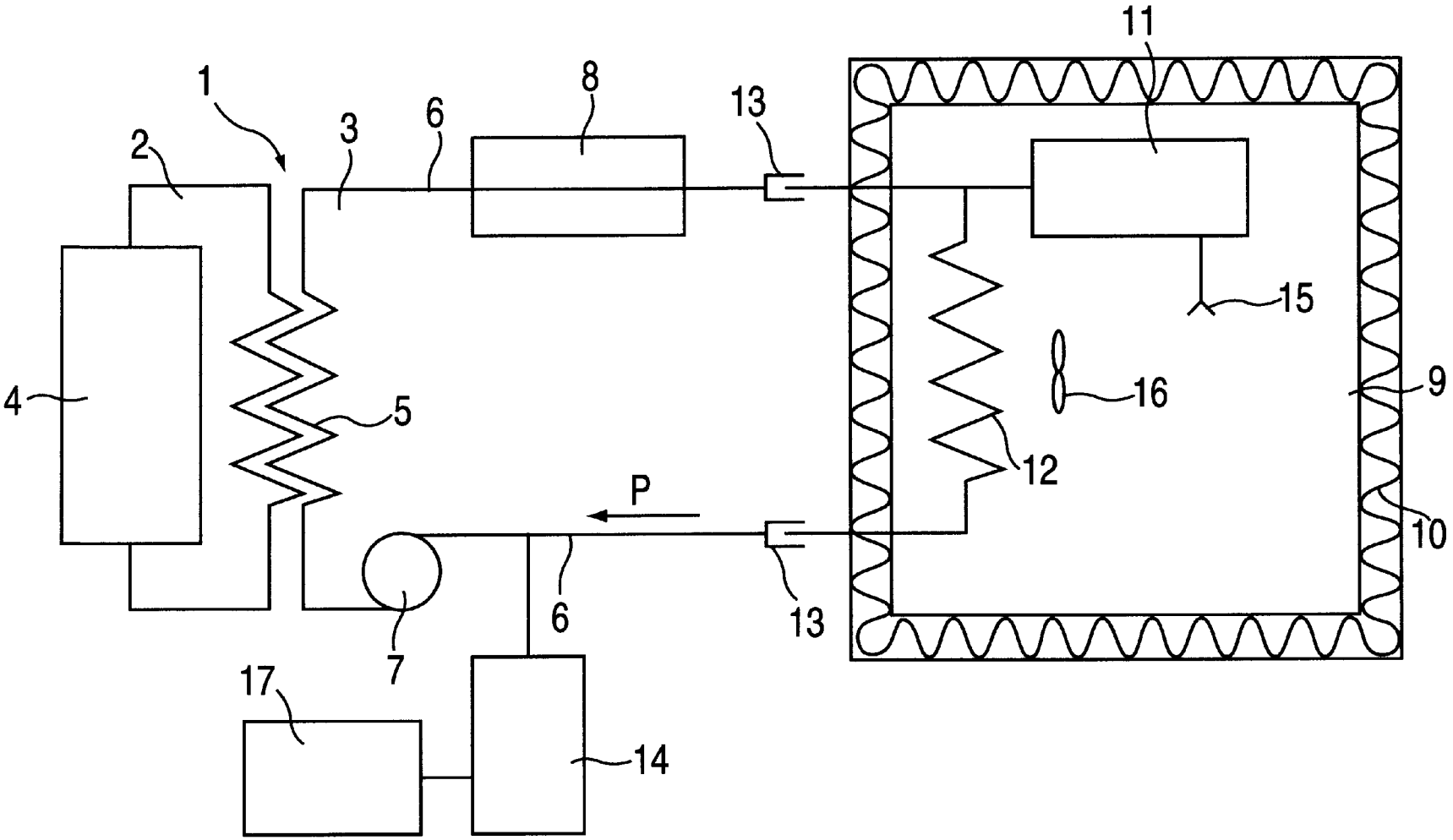
FIG. 2 is an alternative embodiment of the system of FIG. 1, schematically showing an internal combustion engine for providing a source of carbon dioxide to the system, as a cold carrier, in accordance with the principles of the present invention.

A cooling system 1 consists of a primary circuit 2 and a secondary circuit 3. The primary circuit 2 is of a known type and contains a cooling unit 4 for generating cold. The cold is transferred to the secondary circuit 3 through a heat exchanger 5. In the secondary circuit 3 a cold carrier in the form of pressurized carbon dioxide flows through a pipe system 6 in the direction indicated by the arrow P. A circulation pump 7 passes the new carbon dioxide through the heat exchanger 5 for cold absorption from the primary circuit, and on through a cold store 8 where cold can be emitted for storage, for subsequent emission back to secondary circuit. The cold carrier flows on through a releasable coupling 13 into a container 9 with goods (not shown). The container can either flow into a cold store 11, which will be described in more detail later, or it can flow into a heat exchanger 12 for emission of cold to the container 9 by means of a fan 16. From the heat exchanger 12 the cold carrier can flow out of the container through a new releasable coupling 13 and on to the circulation pump 7.

The two cold stores 8 and 11 are only illustrated schematically in the figure, and may be designed in many ways. Nor does the figure show valves, instruments and other components which are necessary for a complete cooling system, since these other components are of a known type, and are of no consequence for the invention.

The cold stores 8 and 11 may consist of dry ice, and are supplied with cold by the controlled release of the secondary circuit's carbon dioxide, the carbon dioxide thereby forming dry ice as the pressure is reduced. Cold is emitted from the cold stores when the dry ice evaporates, forming carbon dioxide in gaseous form during emission of cold. In the cold store 8 this cold is used to cool the liquid carbon dioxide which is located in the pipe system. In the cold store 11, which is in communication with the interior of the container, the cold can be emitted in several ways: the cold can be transferred from the carbon dioxide in gaseous form to the carbon dioxide in the pipe system, the carbon dioxide in gaseous form to the carbon dioxide in the pipe the container, or carbon dioxide in gaseous form can be led via an outlet 15 into that part of the container which contains the goods, thus cooling them directly. This latter method is advantageous for the container's atmosphere, since the carbon dioxide will reduce the growth of micro-organisms and contribute to the preservation of the foodstuffs.

The cold stores 8 and 11 can also consist of enclosed quantities of pressurized carbon dioxide. A store of this kind can be achieved by means of a pressure vessel, or by using pipes and manifolds which already exist in the container, perhaps increasing their dimensions. This latter alternative is considered to be advantageous, since it provides a simple and reasonably priced version of the cold store. Cold is emitted by pressure reduction under the controlled release of a portion of the carbon dioxide, thus forming dry ice. The cold can then be transferred as described above.

When the cold stores 8 and 11 are used, carbon dioxide will be consumed in the secondary circuit. Hence, in order to maintain the operation the supply of carbon dioxide has to be replenished. In the embodiment in the figure this is done by means of a $CO_2$ generator 14. The $CO_2$ generator may preferably be based on membrane technology, being supplied with exhaust gasses from an internal combustion engine 17. The exhaust gases are passed through the membranes, and due to the properties of the membranes, $CO_2$ is separated from the other exhaust gases. The $CO_2$ generator further contains a compressor which pressurizes the carbon dioxide before it is supplied to the secondary circuit.

In the above the invention has been explained with reference to a specific embodiment described by means of a schematic flow chart. The process can be advantageously controlled by a microprocessor (not shown) which receives information from instruments and a control console, controlling the process by means of controlled valves. Thus it is obvious that a number of different possibilities exist for instrumentation, control and localisation of valves in the process. Similarly it is obvious that the pipe system can be designed in other way, the pump 7, e.g., and the supply of carbon dioxide from the $CO_2$ generator 14 being placed in other locations, there can be connections for more containers 9, more cold stores 8 can be provided in the secondary circuit, and bypass lines can be provided around the different components.

The cold emission from the dry ice stores can be self-regulating, the cold in the secondary circuit normally being kept at a level where the evaporation of carbon dioxide from the dry ice is zero or minimal. Should the temperature rise in the container the evaporation will increase by itself, and the carbon dioxide in gaseous form will cool the interior of the container. In this manner a reasonably priced and reliable regulation is obtained of the cold emission from the cold stores.

I claim:

1. A method for cooling a container, comprising:

generating cold in a primary circuit containing a cooling medium;

supplying said cold to a cold carrier in a secondary circuit via a first heat exchanger;

storing at least part of said cold from said secondary circuit in a cold store;

emitting from none to all of said cold from said cold store;

carrying said cold in pressurized carbon dioxide, through releasably coupled pipes, into a container using said secondary circuit;

transferring said cold from said secondary circuit to said container via a heat exchanger; and repeating said supplying, storing, emitting, carrying, and transferring.

2. A method according to claim 1, wherein in said storing at least part of said cold is stored inside said container.

3. A method according to claim 2, wherein said storing comprises:

forming dry ice by reducing the pressure of the carbon dioxide; and wherein said emitting comprises allowing said dry ice to evaporate.

4. A method according to claim 3, further comprising:

receiving the exhaust gas from an internal combustion engine;

generating carbon dioxide from said exhaust gas; and replenishing carbon dioxide of said secondary circuit with carbon dioxide generated by said generating.

5. A method according to claim 2, wherein said storing comprises enclosing a quantity of carbon dioxide and said emitting comprises reducing the pressure of said quantity of carbon dioxide.

6. A method according to claim 5 wherein said emitting further comprises forming dry ice and allowing said dry ice to evaporate.

7. A method of according to claim 5, further comprising:

receiving the exhaust gas from an internal combustion engine;

generating carbon dioxide from said exhaust gas; and replenishing carbon dioxide of said secondary circuit with carbon dioxide generated by said generating.

8. A method according to claim 1, wherein an said storing at least part of said cold is stored outside said container.

9. A method according to claim 8, wherein said storing comprises:

forming dry ice by reducing the pressure of the carbon dioxide; and wherein said emitting comprises allowing said dry ice to evaporate.

10. A method according to claim 9, further comprising:

receiving the exhaust gas from an internal combustion engine;

generating carbon dioxide from said exhaust gas; and replenishing carbon dioxide of said secondary circuit with carbon dioxide generated by said generating.

11. A method according to claim 8, wherein said storing comprises enclosing a quantity of carbon dioxide and said emitting comprises reducing the pressure of said quantity of carbon dioxide.

12. A method according to claim 11 wherein said emitting further comprises forming dry ice and allowing said dry ice to evaporate.

13. A method of according to claim 11, further comprising:

receiving the exhaust gas from an internal combustion engine;

generating carbon dioxide from said exhaust gas; and replenishing carbon dioxide of said secondary circuit with carbon dioxide generated by said generating.

14. A system for cooling a container comprising:

a primary circuit having a cooling medium for generating cold; and a secondary circuit, said secondary circuit containing pressurized carbon dioxide for carrying said cold and having a first portion and a second portion, said first portion being releasably coupled to said second portion, wherein:

in said first portion of said secondary circuit, said pressurized carbon dioxide of said secondary circuit is in thermal communication with said cooling medium of said primary circuit to receive cold from said primary circuit;

said second portion is disposed at least partially within said container;

said second portion is in thermal communication with said container to supply cold to said container; and said first and second portions of said secondary circuit together comprise:

a cold store for storage of cold and emission of cold in the event of an interruption in the cold supply; and a means of conducting said cold carrier from said primary circuit and said cold store to said container.

15. The system of claim 14 wherein said cold store is connected to said second portion or said secondary circuit.

16. The system of claim 15 wherein said cold store is disposed inside said container.

17. The system of claim 16 wherein said cold store comprises an enclosed quantity of pressurized carbon dioxide that emits cold when pressure of said carbon dioxide is reduced.

18. The system of claim 15 wherein said cold score comprises dry ice.

19. The system of claim 15 wherein said dry ice is generated by a reduction in the pressure of said carbon dioxide.

20. The system of claim 15 wherein said dry ice of said cold store is in communication with said interior of said container and is able to provide carbon dioxide to said atmosphere of said interior.

21. The system of claim 14 wherein said cold store is connected to said first portion of said secondary circuit.

22. The system of claim 21 wherein said cold store comprises dry ice.

23. The system of claim 22 wherein said dry ice is generated by a reduction in the pressure of said carbon dioxide.

24. The system of claim 21 wherein said cold store comprises an enclosed quantity of pressurized carbon dioxide that emits cold when pressure of said carbon dioxide is reduced.

* * * * *